United States Patent [19]

Mishcon et al.

[11] 4,033,150

[45] July 5, 1977

[54] CIRCULAR KNITTING MACHINE FOR PRODUCING DETACHABLE STRIPS OF KNITTED FABRIC

[75] Inventors: Lester Mishcon, Miami Beach, Fla.; John Christopoulos, Brentwood, N.Y.

[73] Assignee: The Singer Company, New York, N.Y.

[22] Filed: Nov. 10, 1976

[21] Appl. No.: 740,513

Related U.S. Application Data

[63] Continuation of Ser. No. 564,020, April 1, 1975, abandoned.

[52] U.S. Cl. ..... 66/138; 66/19; 66/172 R

[51] Int. Cl.[2] ..... D04B 15/58

[58] Field of Search ..... 66/19, 25, 131, 138, 66/50 A, 111, 172 R, 24, 132 T

[56] References Cited

UNITED STATES PATENTS

| | | | |
|---|---|---|---|
| 2,153,019 | 4/1939 | Holmes | 66/24 |
| 2,763,144 | 9/1956 | Bristow | 66/172 R X |
| 2,881,603 | 4/1959 | Vendetti | 66/172 R X |
| 3,798,930 | 3/1974 | Mishcon et al. | 66/138 |

OTHER PUBLICATIONS

*Variatex Machine for Knitting Flat Stitch-Shaped Sweater Blanks*, in Knitting Times; 41(30) pp. 54–56, July 17, 1972.

*Blone, J. H. Eight Machines Knit 3,500 Doz Sweaters Weekly*, in Textile World, May 1956.

*Primary Examiner*—Mervin Stein
*Assistant Examiner*—Andrew M. Falik
*Attorney, Agent, or Firm*—Edward L. Bell; Robert E. Smith; William V. Ebs

[57] ABSTRACT

A cylinder and dial circular knitting machine is provided with:

1. a striping box that may feed a draw thread or yarn,
2. adjustable placer and raise cams, and
3. means for controlling the operation of such striping box and cams so as to cause the machine to knit fabric separable at single courses of draw threads into strips of predetermined widths with locked and non-running edges.

5 Claims, 26 Drawing Figures

Fig. 5
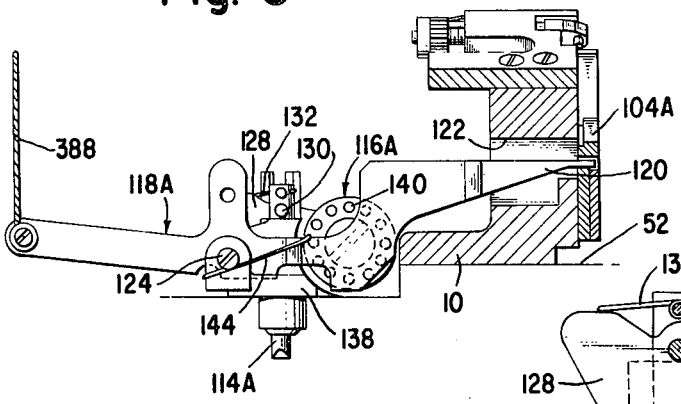
Fig. 6
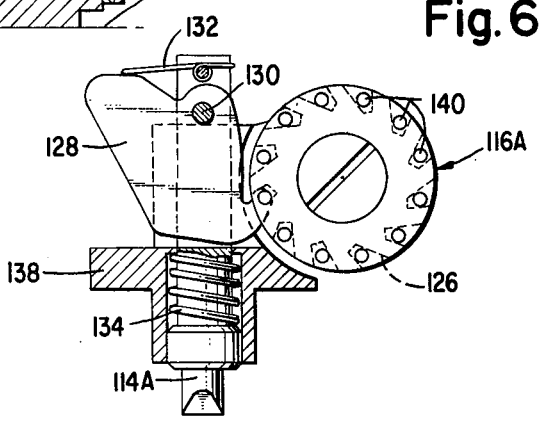
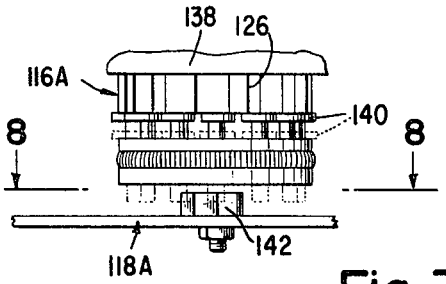
Fig. 7
Fig. 8
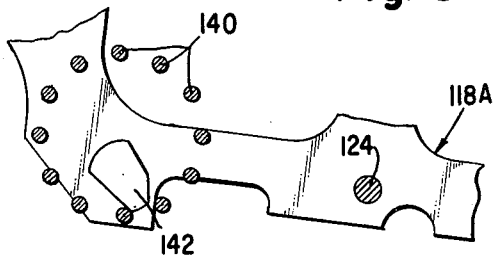
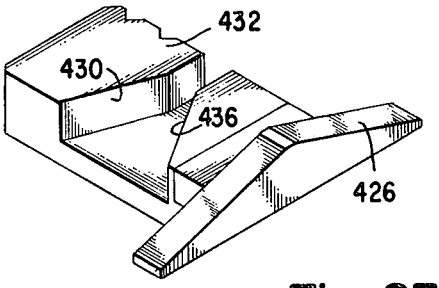
Fig. 23

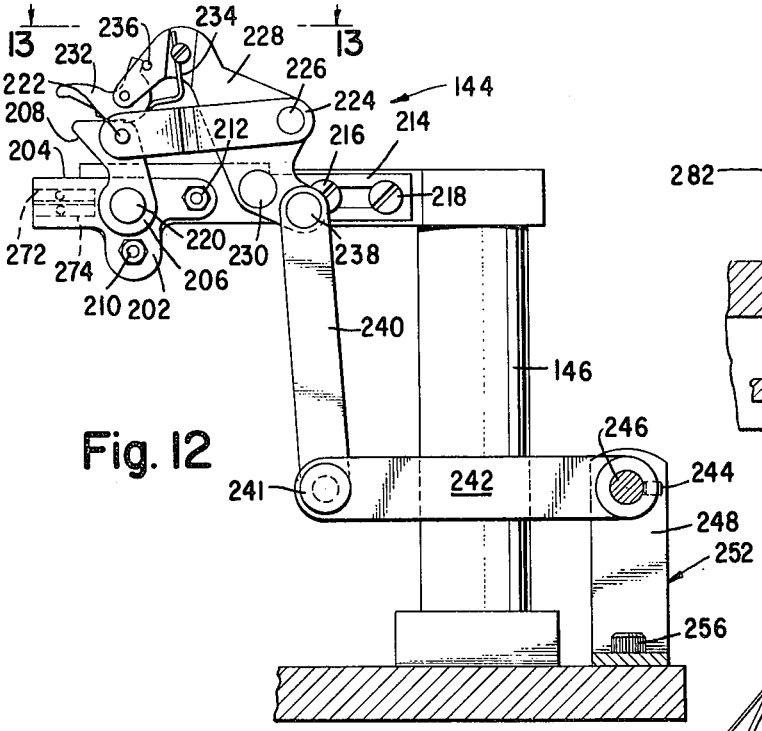
Fig. 12
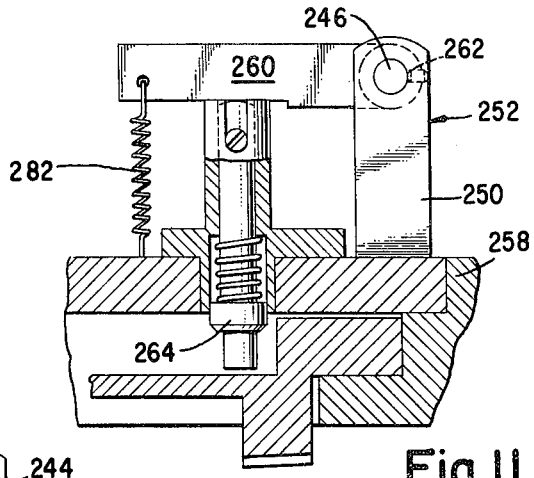
Fig. 11
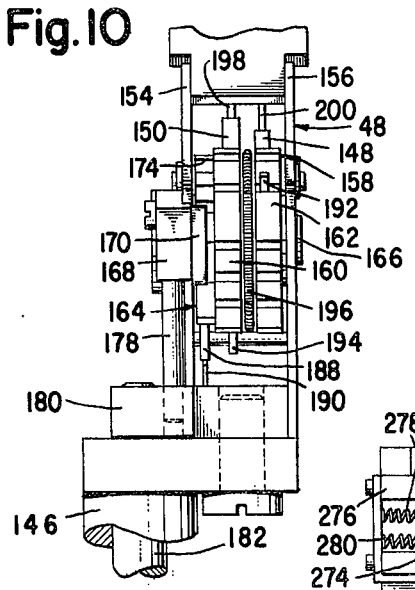
Fig. 10
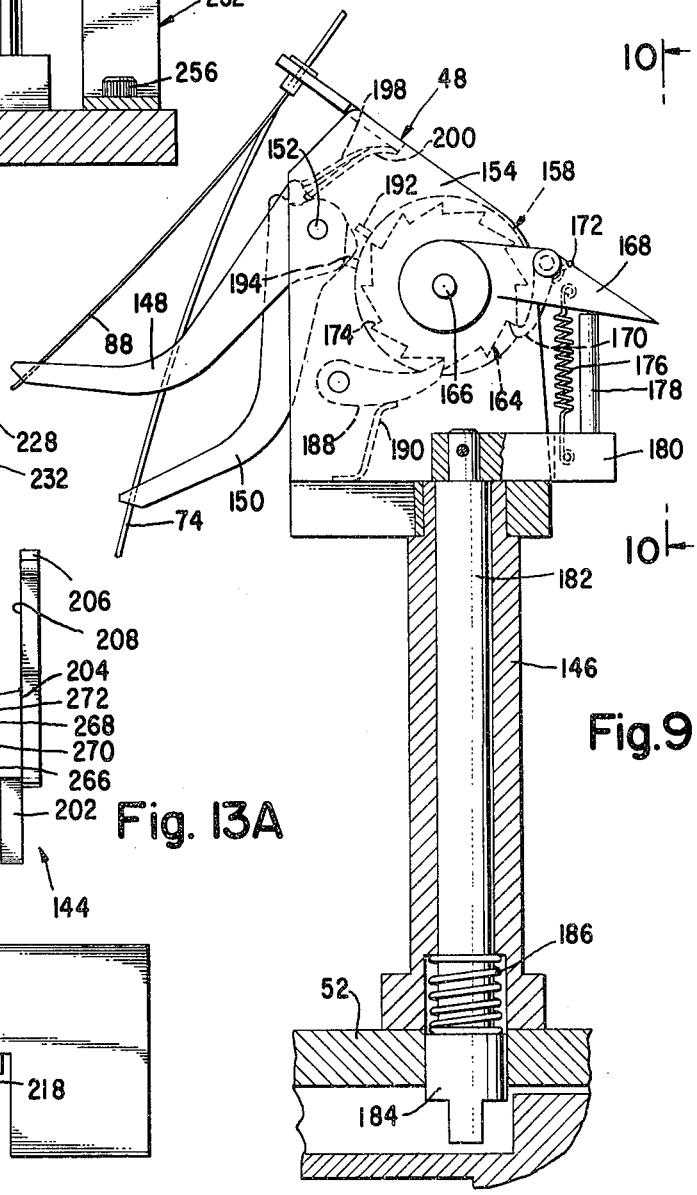
Fig. 9
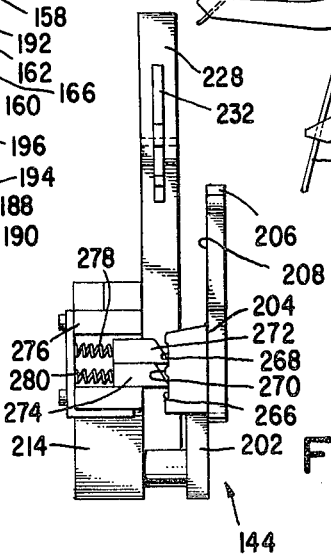
Fig. 13A
Fig. 13
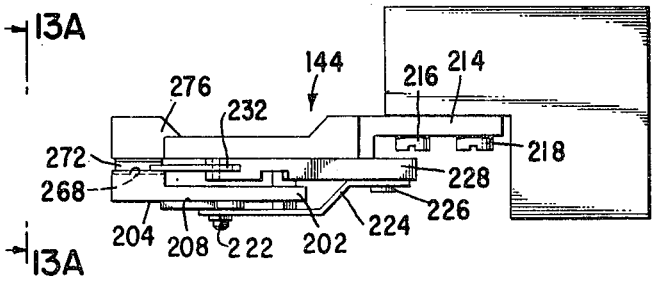

Fig. 16
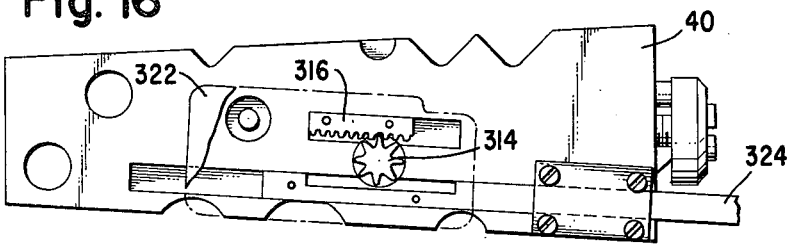
Fig. 14
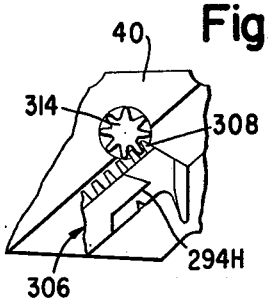
Fig. 17
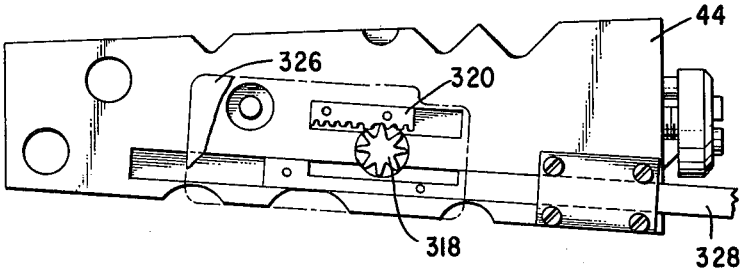
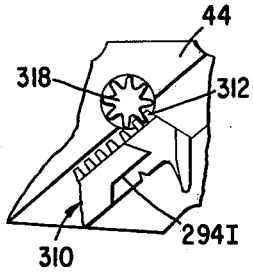
Fig. 15
Fig. 19
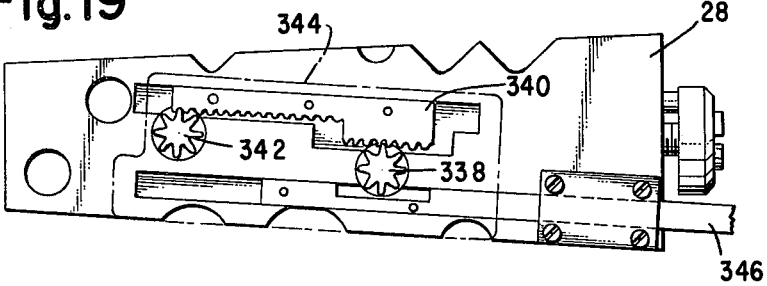
Fig. 18
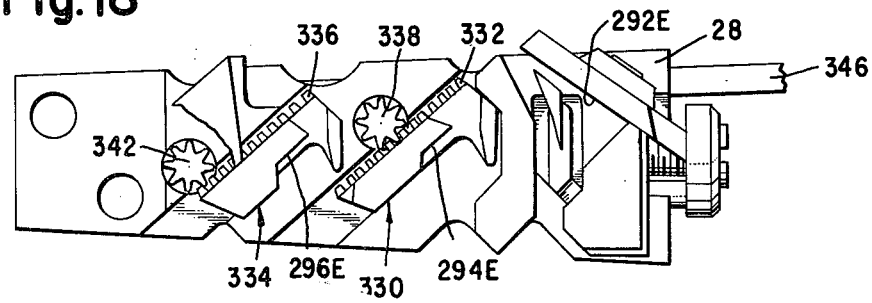

CIRCULAR KNITTING MACHINE FOR PRODUCING DETACHABLE STRIPS OF KNITTED FABRIC

This is a continuation of aplication Ser. No. 564,020, filed Apr. 1, 1975 now abandoned.

BACKGROUND OF THE INVENTION

1. Field of the Invention

The invention relates to machines for producing sweaters, dresses and the like, and for producing trim for use on the bottom edge of garments and on collars and cuffs. More particularly the invention is directed to a circular knitting machine capable of producing separable knitted strips of fabric in various widths and in a variety of stitch constructions.

2. Description of the Prior Art

Separable knitted strips of fabric can be produced on flat bed knitting machines and on circular machines. The flat bed machines must however be run at low speed and they are generally single feed units so that their output is small. It is therefore preferable to use circular knitting machines since they are multi-feed and can be operated at high speed without difficulty. Neither type of machine however has been capable of producing ribbed strips with a clear sharp good looking edge the stitches of which will not pull out when the fabric is stretched in the direction of the courses of the material.

SUMMARY OF THE INVENTION

In accordance with the invention, a cylinder and dial circular knitting machine is provided on a number of successively disposed cam supporting section blocks (small in number as compared to the total number of cam section blocks) with camming that includes automatically controllable placer and raise cams operable between welt and knit positions, and at one such cam section block a striping box is provided for feeding a draw thread or yarn. Such camming and the striping box enable the machine to produce fabric separable into strips with locked and non-running edges, and in widths which can be predetermined by programming the operation of control mechanisms operatively associated with the placer and raise cams, and the striping box. Positive yarn feeding means on the machine is controlled so as to cause yarn supplied to needles at the automatically controllable cams to be positively fed only when knitted into stitches in fabric produced on the machine and to cause yarn for the striping box to be positively fed only when the striping box has been operated to feed yarn rather than separating thread.

DESCRIPTION OF THE DRAWINGS

FIG. 5 is an enlarged side elevational view partially in section of a cylinder cam section block and associated cam actuating mechanism;

FIG. 6 is a enlarged side elevational view of a portion of the cam actuating mechansim of FIG. 5;

FIG. 7 is an enlarged top view of a portion of the mechanism shown in FIG. 6;

FIG. 8 is an enlarged fragmentary side view taken on the plane of the line 8 — 8 of FIG. 6;

FIG. 9 is an enlarged side elevational view showing the striping box of the machine of the invention;

FIG. 10 is an enlarged rear elevational view taken on the plane of the line 10 — 10 of FIG. 9;

FIG. 11 is a an enlarged side elevational view showing actuating mechanism for a cutter used in conjunction with the striping box;

FIG. 12 is an enlarged side elevational view of the cutter;

FIG. 13 is a top plan view taken on the plane of the line 13 — 13 of FIG. 12.

FIG. 13A is an end view of the cutter taken on the plane of the line 13A—13A of FIG. 13;

FIG. 14 is an enlarged fragmentary bottom view of a dial cam section block;

FIG. 15 is an enlarged fragmentary bottom view of another dial cam section block;

FIG. 16 is a top plan view of the dial cam section block of FIG. 14;

FIG. 17 is a top plan view of the dial cam section block of FIG. 15;

FIG. 18 is an enlarged bottom view of still another dial cam section block;

FIG. 19 is a top plan view of the dial cam section block of FIG. 18;

FIG. 23 is an enlarged perspective view of a plunger actuating cam used in the machine of the invention;

DESCRIPTION OF THE PREFERRED EMBODIMENT

Figure 1:
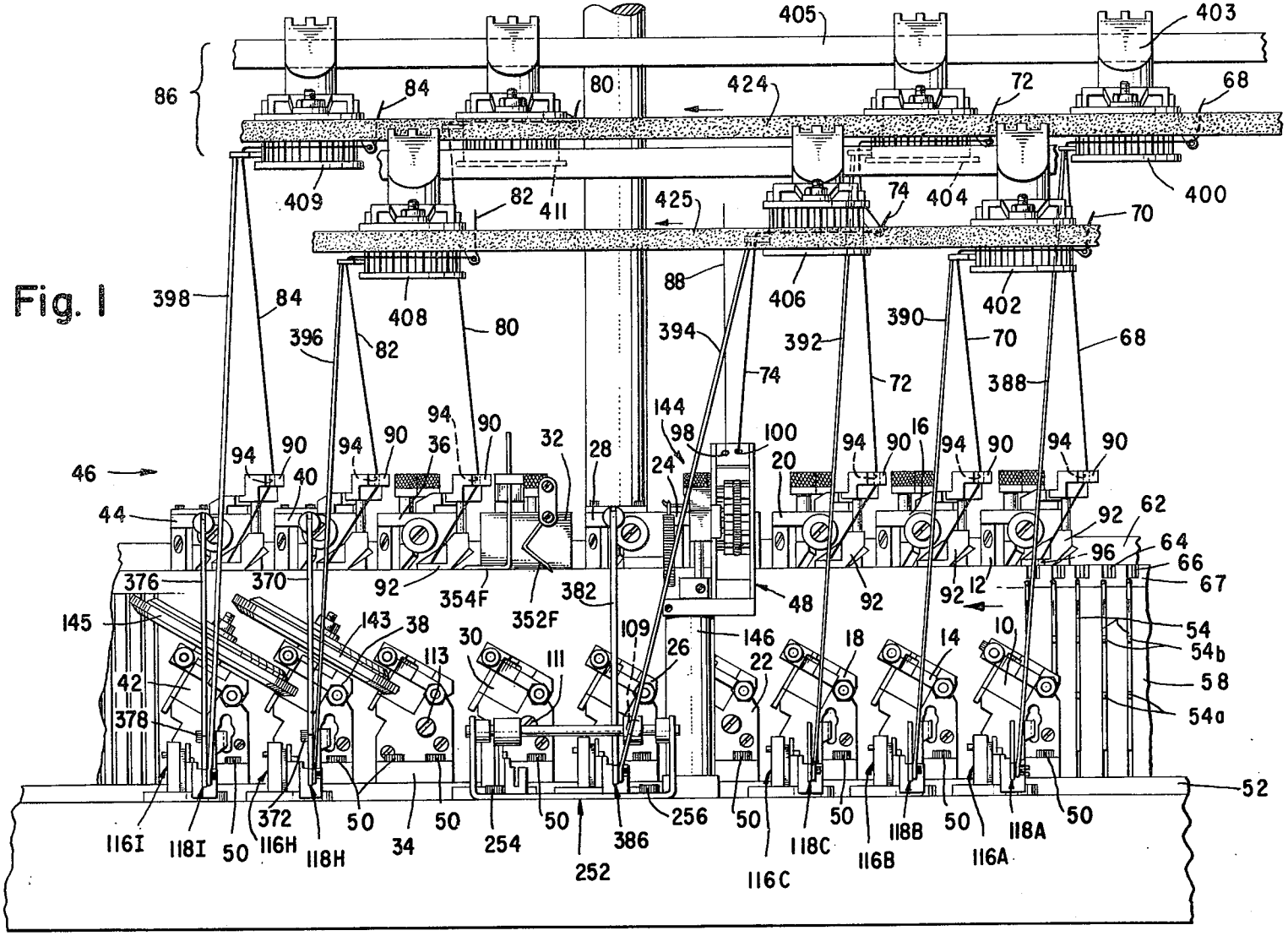
FIG. 1 is an elevational view of a portion of a circular knitting machine according to the invention.

Referring to the drawings, and especially to FIGS. 1, 2, 3, and 4, reference characters 10 and 12, 14 and 16, 18 and 20, 22 and 24, 26 and 28, 30 and 32, 34 and 36, 38 and 40, 42 and 44, designate pairs of cylinder and dial cam section blocks of a circular knitting machine 46. Such section blocks support needle actuating cams which in conjunction with a striping box 48 at section block pairs 22 and 24 and mechanism hereinafter described for controlling certain of the cams and the striping box render the machine capable of producing separable strips of fabric of predetermined widths. The cylinder section blocks, that is section blocks 10, 14 18, 22, 26, 30, 34, 38 and 42 are secured by bolts 50 to retaining ring 52 of the machine such that the cams hereon may engage and position needles 54, vertically reciprocable in a cylinder 58, upon relative rotation of the cylinder and cams. The dial section blocks 12, 16, 20, 24, 28, 32, 36, 40 and 44 are secured by bolts 60 to a ring 62 such that the cams on these blocks may engage and position needles 64 and 66, radially reciprocable in a dial 67, upon rotation of the dial with the cylinder.

The cylinder needles 54 all have corresponding lower butts 54*a* engageable wit cams and corresponding upper butts 54*b* engageable with pattern wheels. The dial needles 64 and 66 have differently located inner butts 64*a* and 66*a* respectively and correspondingly located outer butts 64*b* and 66*b*.

Yarns 68, 70, 72, 74, 80, 82 and 84 are supplied from spools (not shown) to positive feeding means 86 which is of the type shown and described in U.S. Pat. No. 3,090,215 for "Device for Guided Feeding of Yarn to Knitting Machines" issued May 21, 1963 to Karl Isac Joel Rosen, but which is so adapted and so controlled that it may be caused to engage or disengage yarns 68, 70, 72, 82 and 84. Yarns 68, 70, 72, 80, 82 and 84 extend from the positive feeding. means to needles at the section block pairs 10 and 12, 14 and 16, 18 and 20, 34 and 36, 38 and 40, 42 and 44 respectively. Yarn 74 extends from the positive feeding means to striping box 48 which may be operated either to cause the yarn to be fed to needles at section block pair 22 and 24 or to cause such yarn to assume a non-feeding position. The striping box when not feeding yarn, feeds a draw thread 88, not associated with the positive feeding means, to the needles at section block pair 22 and 24. As shown, yarn guide members 90 and 92 with openings 94 and 96 respectively for yarn 68 are provided on dial section block 12, and similar yarn guide members are provided on dial section blocks 16, 20, 36, 40 and 44. Guides are provided at 98 and 100 on striping box 48 for draw thread 88 yarn 74 respectively.

Figure 2:
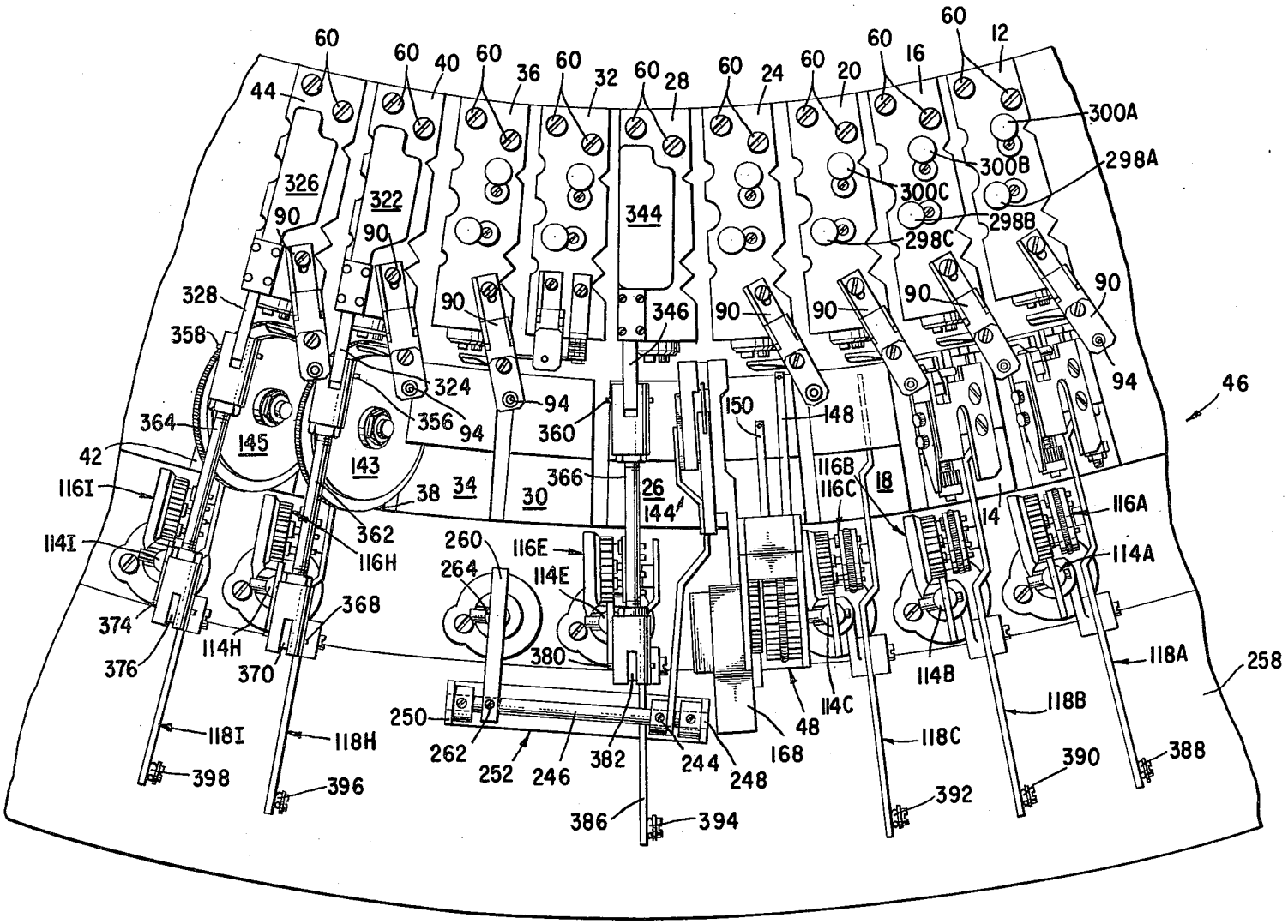
FIG. 2 is a top plan view of that portion of the machine which is shown in FIG. 1.
Figure 3:
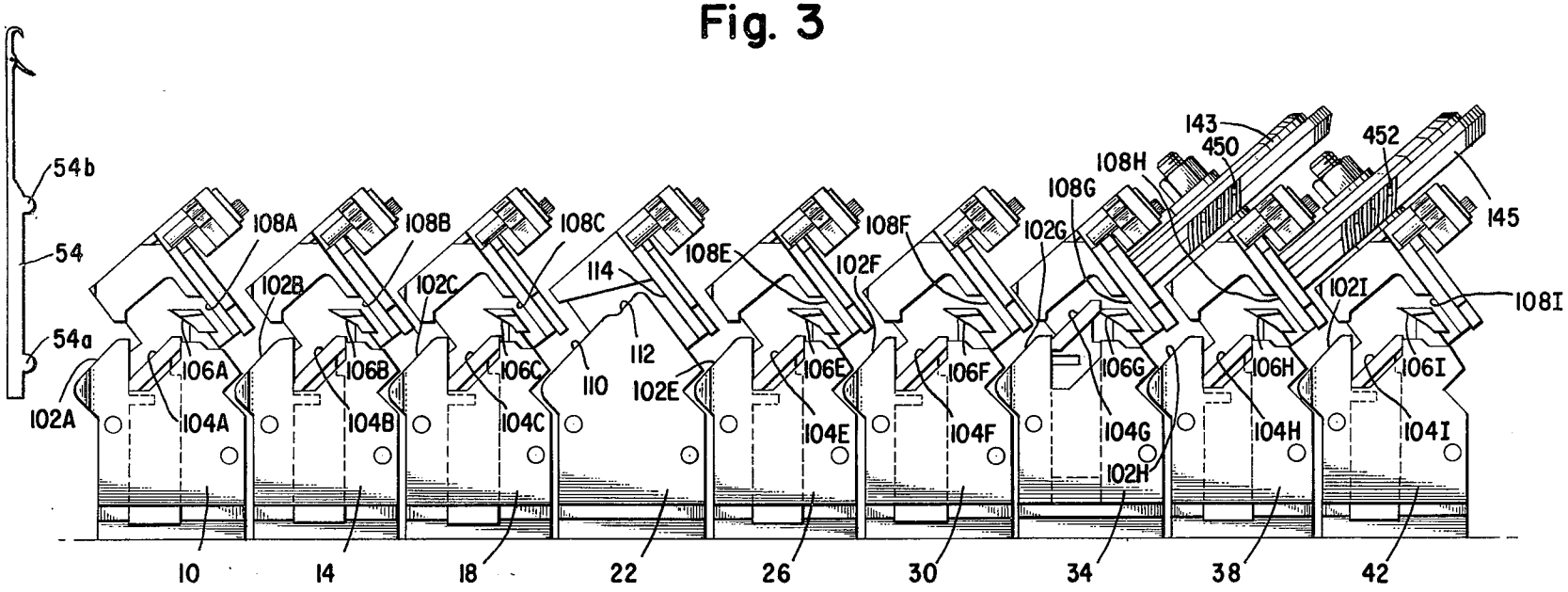
FIG. 3 is an enlarged elevational view taken from the inside of the machine and showing the cylinder cam section blocks for the portion of the machine depicted in FIGS. 1 and 2.

The camming on each of cylinder section blocks 10, 14, 18, 26, 30, 34, 38 and 42 is similar and is of the type shown and described in U.S. Pat. No. 3,513,666 issued May 22, 1970 to L. Mishcon for Circular Knitting Machine with Pattern Wheels. A modified form of camming is however provided on cylinder section block 22. As shown, cylinder cam section blocks 10, 14, 18, 26, 30, 34, 38 and 42 support like raise cams 102 (A, B, C, E, F, G, H, and I respectively), like pattern placer cams 104 (A, B, C, E, F, G, H and I respectively), like wing cams 106 (A, B, C, E, F, G, H and I respectively), and like stitch cams 108 (A, B, C, E, F, G, H and I respectively). Section block 22 supports integral raising cams 110 and 112, and a stitch cam 114 which position needles 54 for the knitting of yarn 74 and separating thread 88. Pattern placer cams 104E, 104F and 104G are manually adjustable vertically in the manner shown and described in the said U.S. Pat. No. 3,513,666 by screws 109, 111, and 113 respectively. Pattern placer cams 104E and 104F are set in positions permitting cylinder needles to welt and pattern placer cam 104G is set in the knit position (FIG. 3 positions) for the knitting of separable strips of fabric. Each of pattern placer cams 104A, 104B, 104C, 104H and 104I may be automatically positioned during knitting of the separable strips by mechanism which is responsive to the operation of control means hereinafter described and which includes a plunger 114 (A, B, C, H, and I respectively), ratcheting device 116 (A, B, C, H and I respectively) and pivoted lever 118 (A, B, C, H and I respectively) as shown in FIG. 2. The ratcheting devices 116 (A, B, C, H and I) are of the type shown and described in the U.S. Pat. No. 2,539,790 issued Jan. 30, 1951 to L. Mishcon et. al. for Knitting Machine with Selector Wheel Nullifying Cams. Each plunger, ratcheting device and pivoted lever connects with its associated placer cam in the manner shown in FIG. 5 for pattern placer cam 104A.

As may be seen in FIG. 5, pattern placer cam 104A connects with a finger 120 which is an integral part of lever 118A and which extends through a slot 122 in the section block 10 to engage the cam. Lever 118A is pivoted on a pin 124 affixed in the ratcheting device 116A which is secured to retaining ring 52. The ratcheting device (FIG. 6) includes a rotatable toothed ratchet wheel 126 and a pawl 128 which is pivotally attached to plunger 114A on pin 130 biased by a spring 132 into engagement with the ratchet wheel. The plunger 114A is movable against the bias of a spring 134 between a lowered position wherein the pin 130 engages the housing 138 of the device and a raised position. Whenever the plunger 114A is moved from its lowered to its raised position the ratchet wheel is advanced one tooth by the pawl 128.

Ratchet wheel 126 carries a number of horizontally slidable pins 140 which may be individually moved into either an actuating position (dotted line positions, FIG. 7) or a non-actuating position (solid line positions, FIG. 7). When in its actuating position, a pin is effective once during each revolution of the ratchet wheel, as the wheel is indexed, to engage a cam 142 secured to lever 118 (FIG. 8) and so cause the lever to be pivoted about pin 124 such that finger 120 and placer cam 104A are moved to raised positions. A pin in the non-actuating position however cannot so engage cam 142 and cause it to move lever 118A. Finger 120 and placer cam 104A after being raised by the action of a pin 124, in the actuating position, on cam 142, are maintained in their raised positions by continued engagement of the pin and cam between indexing movements, and are lowered by the action of spring 144 on lever 118A whenever the wheel is moved into a position where there is no pin disposed to engage cam 142.

The raised position of placer cam 104A is one where it may act on the lower butts 54*a* of cylinder needles 54 (FIG. 3) and raise such needles to a latch clear yarn accepting position. The lowered position of cam 104A is one permitting needles 54 to welt. Automatically operated pattern placer cams 104B, 104C, 104H, and 104I are positioned in cylinder section blocks 14, 18, 38, and 42 respectively in the same manner as pattern placer cam 104A is positioned in cylinder section block 10. They also serve when in their raised positions to lift needles 54 to the latch clear yarn accepting position and when in their lowered positions permit such needles to welt.

Section blocks 38 and 42 supporting the automatically operated pattern placer cams 104H and 104I also support pattern wheels, 143 and 145 respectively which are engageable with the upper butts 54*b* of cylinder needles 54. Such pattern wheels are provided to act selectively on the needles 54 when the pattern placer cams 104H and 104I are in their lowered positions.

As may be seen in FIG. 1 striping box 48 and an associated cutting mechanism 144 are secured to a post 146 which is affixd to retaining ring 52 in close proximity to section block 22. The striping box (see FIGS. 9 and 10) includes fingers 148 and 150 which carry draw thread 88 and yarn 74 respectively and cause one or the other to be fed to needles of the machine. As shown, the fing 148 and 150 are pivotally mounted on a rod 152 between check plates 154 and 156.

The striping box 48 includes a drum 158 having annular sets of teeth 160 and 162. A ratchet wheel 164 is affixed to the drum 158 and both the wheel and drum are rotatably mounted on a fixed shaft 166. An arm 168 rotatably mounted on shaft 166 includes a pawl 170 which is biased by a spring 172 into engagement with the teeth 174 of ratchet wheel 164. Arm 168 is urged by a spring 176 into contact with a pin 178 located on a member 180 that is affixed to a vertically movable rod 182. A plunger 184 formed on the lower end of rod 182 extendings through retaining ring 52 as shown. The plunger 184 and rod 182 are biased downwardly by a spring 186 into a position where member 180 engages the upper end of post 146, but may be moved upwardly as hereinafter described whereupon arm 168 is pivoted on shaft 166 by pin 178 and pawl 170 is caused to impart an indexing movement to ratchet wheel 164 and drum 158. A pawl 188 biased by a spring 190 into engagement with the teeth 174 of ratchet wheel 164 prevents reverse movement of the wheel and drum.

Adjustable jacks 192 and 194 are of the type shown, for example, in U.S. Pat. No. 3,620,049 isued Nov. 16, 1971 to L. Mishcon et. al. for Striping Box for Circular Machine with Adjustable Finger Acutating Jacks are provided in spaces between teeth of the drum 158 to interact with fingers 148 and 150 respectively. The jacks are held in the drum by annular spring 196. The jacks are so located in the slots of the drum that in each indexed position of the drum one of the fingers engages a jack and the other engages the surface of the drum. A jack in engagement with a finger holds the finger in the feeding position (position of finger 148 in FIG. 9). When not engagement with a jack a finger is maintained in a non-feeding position (position of finger 150 in FIG. 9) by a spring exerting a torque on the finger around rod 152. Such a spring 198 is provided for finger 184 and a like spring 200 is provided for finger 150.

Cutting mechanism 144 (FIGS. 12 and 13) includes a stationary arm 202 with a cutting edge 204, and movable arm 206 with a cutting edge 208. The stationary arm is affixed by bolts 210 and 212 to a member 214 which is attached with screws 216 and 218 to fixed structure at the upper end of post 146. Movable arm 206 is pivotally mounted at 220 on the stationary arm 202 and is pivotally connected at 222 to one end of a link 224. The other end of link 224 is pivotally connected at 226 to a hook-shaped member 228 which is pivoted at 230 on member 214. Member 228 is provided at one end with a pivotally mounted wiping finger 232 which is biased by a spring 234 against a stop 236. The other end of member 228 is pivotally connected at 238 to one end of a link 240 which has its other end pivotally connected at 241 to one end of a link 242. The other end of link 242 is affixed by a set screw 244 to a shaft 246 which is rotatably mounted in journals 248 and 250 of a fixture 252 that is bolted at 254 and 256 to stationary outer housing ring 258 of machine 46. (FIGS. 1, 2, 11 and 12). Shaft 246 has a link 260 affixed to it by a set screw 262 and the link 260 is subject to actuation by a plunger 264 which is controlled as later described herein.

When plunger 264 actuates link 260, shaft 246 turns and link 242 moves with the shaft. Link 242 acting through connecting link 240 causes hook-shaped member 228 to be pivoted on its pivotal mounting at 230 and finger 232 is moved downwardly. Finger 232 positions draw thread 88 or yarn 74 being fed to needles at cam section blocks 22 and 24 on cutting edge 204 of arm 202 and causes it to be clamped against surfaces 266 and 268 on opposite sides of a ridge 270 in arm 202 by elements 272 and 274 respectively which are laterally slidable in a fixed arm 276 and biased by springs 278 and 280 in the direction of arm 202. Movable arm 206 which is actuated by link 224 upon movement of member 228 severs the draw thread 88 or yarn 74 at cutting edges 204 and 208. After the draw thread 88 or yarn 74 has been cut by the movement of arm 206 and finger 232 has moved beyond the clamping mechanism, the arm 206 and finger 232 are returned to their original positions by the action of a return spring 282 which is connected at one end to ring 52 and at its other end to the arm 260 that is secured to 262 to shaft 246 (FIG. 11).

Figure 4:
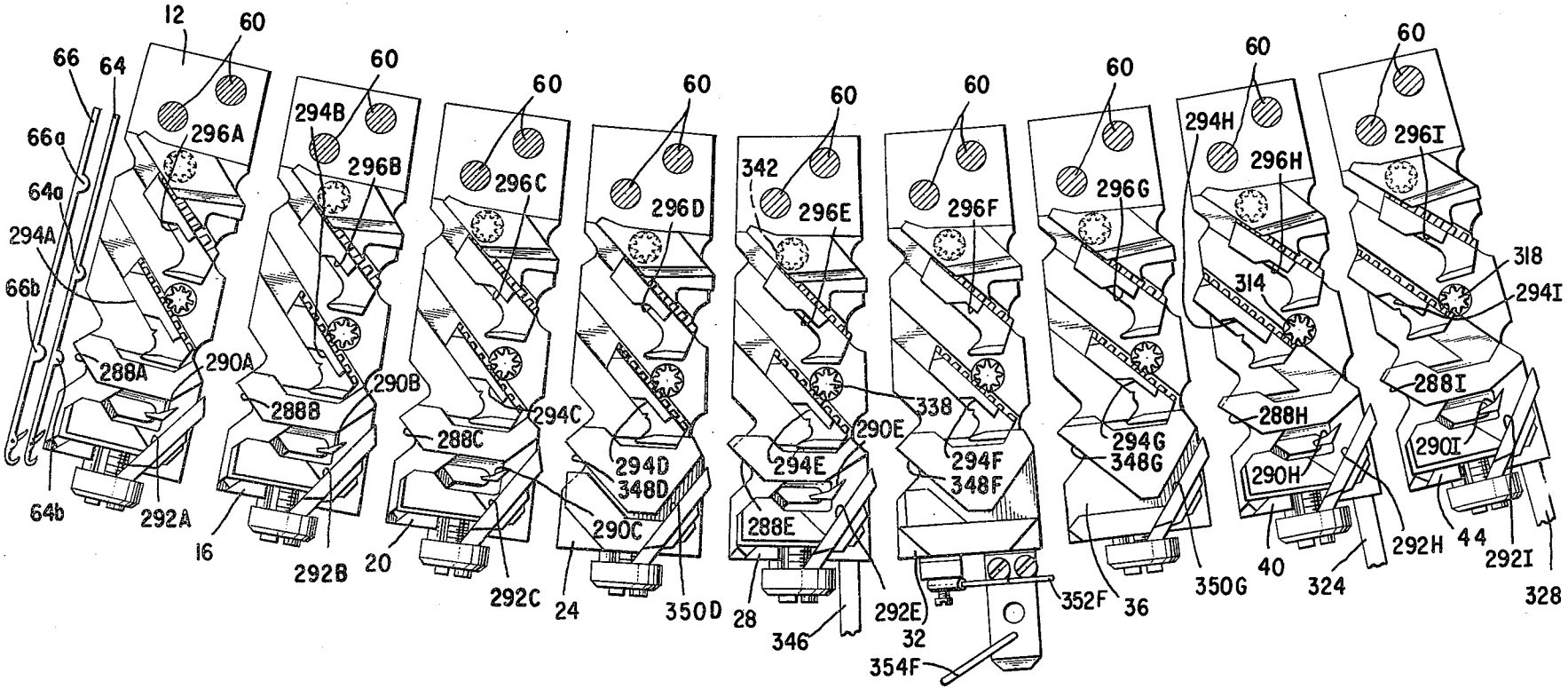
FIG. 4 is an enlarged bottom view taken from inside the machine and showing the dial cam section blocks for the portion of the machine illustrated in FIGS. 1 and 2.

Each of the dial section blocks 12, 16, 20, 28, 40 and 44 of FIGS. 1, 2, and 4 supports similar camming corresponding to that shown and described in the U.S. Pat. No. 3,893,309 issued July 8, 1975 to John Christopoulos and Lester Mishcon for Bridging Cam for Limiting the Position of Welt Needles in a Knitting Machine. As shown in FIG. 4 the camming on such dial section blocks 12, 16, 20, 28, 40 and 44 includes the preliminary raise cams 288 (A, B, C, E, H and I respectively), like wing cams 290 (A, B, C, E, H and I respectively), and like stitch cams 292 (A, B, C, E, H and I respectively). As shown, the camming on section blocks 12, 16, 20, 28, 40 and 44 also includes similar outer raise cams 294 (A, B, C, E, H and I respectively), and other similar inner raise cams 296 (A, B, C, E, H and I respectively).

The outer raise cams 294A, 294B, and 294C are manually movable as in the manner indicated in said Patent Application, Serial No. 415,035 whith the knobs 298A, 298B, and 298C respectively of FIG. 2 into positions wherein such cams engage butts 64*a* to raise needles 64 to knit positions, and into positions permitting these needles to welt. Similarly, inner raise cams 296A, 296B and 296C are manually movable with knobs 300A, 300B and 300C respectively into positions to engage butts 66*a* to raise needles 66 to knit positions, and into positions permitting the needles 66 to welt. However for the knitting of separable strips on machine 46 the outer raise cams 294A, 294B and 294C are set as shown in FIG. 4 in positions to raise needles 64 to knit positions, and the inner raise cams 296A, 296B, and 2096C are set as in FIG. 4 in positions to raise needles 66 knit positions. In section block 28 the outer raise cam 294E and inner raise cam 296E are automatically movable into positions to raise needles 64 and 66 respectively to knit positions, and into positions permitting such needles to welt. In section blocks 40 and 44 outer raise cams 294H and 294I are automatically movable into positions for raising needles 64 to knit position, and into positions permitting such needles to welt. Inner cams 296H and 296I in section blocks 40 and 44 are located in positions to raise needles 66 to knit positions.

Raise cam 294H in section block 40 is formed on a member 306 which includes a toothed portion 308, (FIG. 14), and raise cam 294I in section block 44 is formed on a member 310 including a toothed portion 312 (FIG. 15). Toothed portion 308 on member 306 meshes with a gear 314 which extends through section block 40 to engage the teeth of a rack 316 (FIG. 16), and toothed portion 312 on member 310 meshes with the teeth of a gear 318 which extends through section block 44 to engage the teeth of a rack 320 (FIG. 17). The rack 316 which is affixed to a slidable plate 322 rotates gear 314 to adjust the raise cam 294H in response to the movement of the plate by an attached rod 324. Similarly rack 320 which is affixed to a slidable plate 326 rotates gear 318 to adjust raise cam 294I in response to movement of the plate 326 by an attached rod 328.

In section block 38 (FIG. 18), raise cam 294E is formed on member 330 including a toothed portion 332, and raise cam 296E is formed on a member 334 including a toothed portion 336. Toothed portion 332 on member 330 meshes with a gear 338 which extends through section block 28 to engage the teeth of a rack 340 and toothed portion 336 on member 334 meshes with a ger 342 which extends through section block 28 to also engage teeth of rack 340 (FIG. 19). The rack 340 which is affixed to a slidable plate 344 and engages the gears 338 and 342 adjusts the raise cams 294E and 296E simultaneously in response to movement of the plate by an attached rod 346.

Dial section block 24 (FIG. 4) is without a preliminary raise cam as provided on section blocks 12, 16, 20, 28, 40 and 44, but includes a raise cam 348D to engage butts 64*b* and 66*b* of needles 64 and 66 respectively and thereby raise all dial needles as required to enable such needles to accept either draw thread 88 or yarn 74 when fed by striping box 48. Dial section blocks 32 and 36 are also without a preliminary raise cam but include raise cams 348F and 348G generally similar to raise cam 348D for raising all dial needles to knit positions. Section blocks 24 and 36 include similar stitch cams 350D and 350G respectively but section block 32 is without stitch cam. Section blocks 24, 32 nd 36 include cams 294 (D, F, and G respectively) similar to the cams 294 (A, B, C, E, H and I), and cams 296 (D, F and G respectively) similar to the cams 294 (A, B, C, E, H and I). Cams 294 (D, F, and G) and 296 (D, F and G) occupy fixed positions in section blocks 24, 32 and 36 as shown. They do not serve a needle raising function but by engaging the shanks of dial needles prevent them from tilting out of the dial 64. A wire 352F for opening the latches of dial needles and another wire 354F for holding latches open are mounted on dial section block 32.

Rods 324, 328 and 346 which connect with automatically adjustable raise cams, as hereinbefore noted, pivotally connect at 356, 358 and 360 respectively with other rods 362, 364, and 366 as shown in FIG. 2. Rod 362 pivotally connects as 368 with a link 370 which is secured at 372 to the lever 118H responsive to the operation of ratcheting device 116H. Rod 364 pivotally connects at 374 with a link 376 which is secured at 378 to lever 118I responsove to the operation of ratcheting device 116I. Rod 366 pivotally connects at 380 with a link 382 which is affixed at 384 to a lever 386 pivoted on and responsive to the operation of a ratcheting device 116E that is similar to the other ratcheting devices hereinbefore described. Ratcheting device 116E is operable by a plunger 114E.

Figure 20:
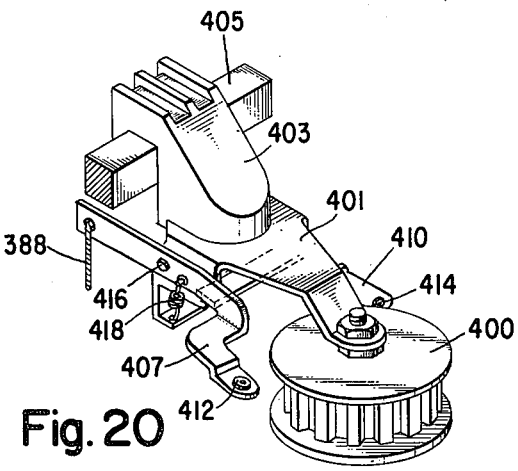
FIG. 20 is an enlarged perspective view of a yarn feeding wheel and associated mechanism operable to position yarn on the wheel.
Figure 22:
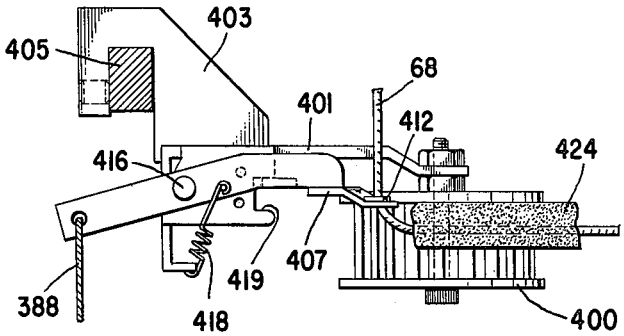
FIGS. 21 and 22 are side views showing the yarn feeding wheel of FIG. 20 with its associated mechanism differently positioned in each of the figures.
Figure 21:
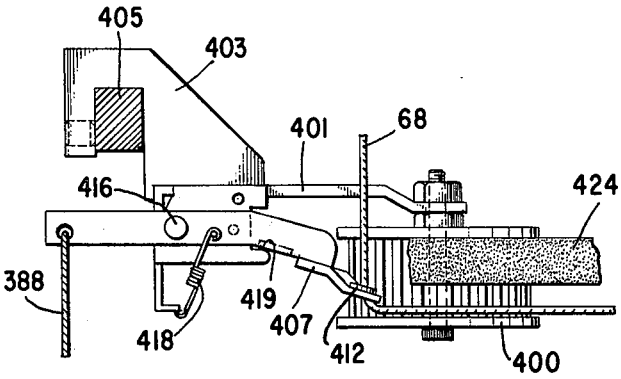

The pivoted levers 118A, 118B, 118C, 386, 118H and 118I connect as shown in FIG. 1 through strings 388, 390, 392, 394, 396 and 398 with movable arms for adjusting the positions of yarn guides associated with wheels 400, 402, 406, 408 and 409 of the positive feeding means 86 and thereby the positions on such wheel of yarns 68, 70, 72, 74, 82 and 84 respectively. The structure for supporting wheels and means for moving the yarn guides is the same at each of these wheels and is shown in FIG. 20 for wheel 400. As may be seen in FIG. 20, wheel 400 is rotatably supported on a bracket 401 which is attached by means of a mounting post 403 to a fixed ring 405 of the machine 46. Arms 407 and 410 supporting yarn guides 412 and 414 respectively are affixed to a shaft 416 which is pivotally mounted in the bracket, and arm 407 is attached to string 388. The arms are biased by a spring 418 into a position wherein arm 407 engages a stop 419 and wherein yarn 68 extending through the yarn guides 412 and 414 is below and out of engagement with feeding belt 424 (FIG. 21). The arms 407 and 410 are however moved by the ratchet operated lever 118A acting through string 388 to a position wherein the yarn 68 is caused to engage an upper part of the wheel under the belt (FIG. 22) wherever ratchet device 116A is operated to move the placer cam 104A to the position for raising needles to knit level. When the ratchet device is operated to move the placer cam 104A to the position permitting needles to welt, tension on the string 388 is relaxed and arms 407 and 410 are moved by spring 418 into a position wherein arm 407 engages the stop 419 thereby causing the yarn to be returned to a position below the belt. In a similar manner yarns 70, 72, 82 and 84 are moved under a belt (424 for yarns 72 and 84, 425 for yarns 70 and 82) whenever ratcheting devices 116B, 116C, 116H and 116I respectively are operated to move operatively connected cylinder and dial cams to knit positions and are moved from under the belt whenever these ratcheting devices are operated to move the cams to positions permitting neeldes to welt. Wheel 406 is so located with respect to belt 425 that whenever ratcheting device 116E is operated to move dial cams 294E and 296E to their radially inward positions and tension on string 394 is relaxed, yarn 74 is moved downwardly to a position under the belt, and whenever the ratcheting device 116E is operated to move dial cams 294E and 296E to their radially outward positions, yarn 74 is moved upwardly into a position out from under the belt in response to movement of yarn guides at the wheel by the string. Yarn 80 is positively fed under belt 424 and over wheel 411 at all times during operation of the machine as in the U.S. Pat. No. 3,090,215 mentioned hereinbefore.

Figure 24:
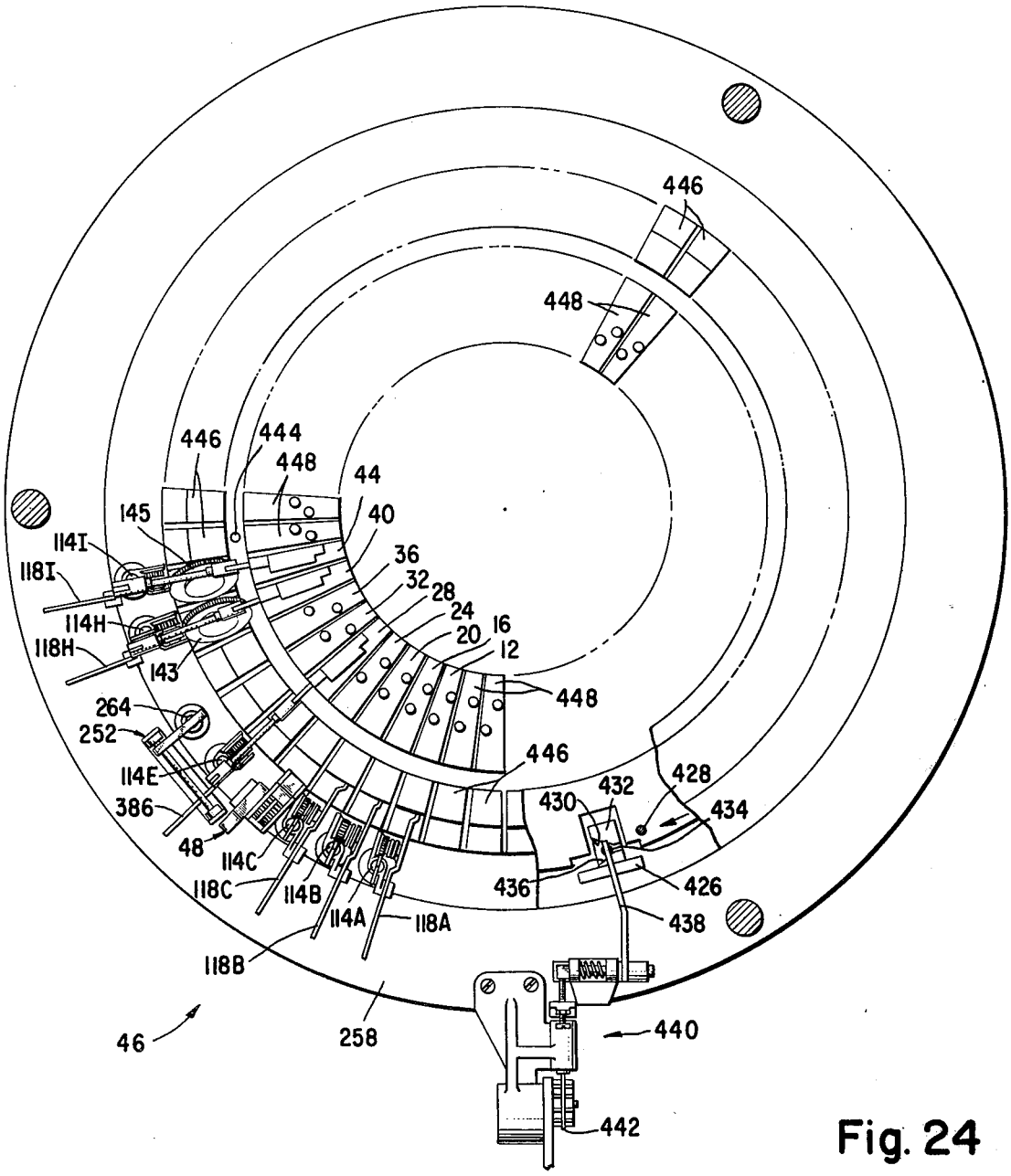
FIG. 24 is a more or less diagrammatic top plan view of the machine.
Figure 25:
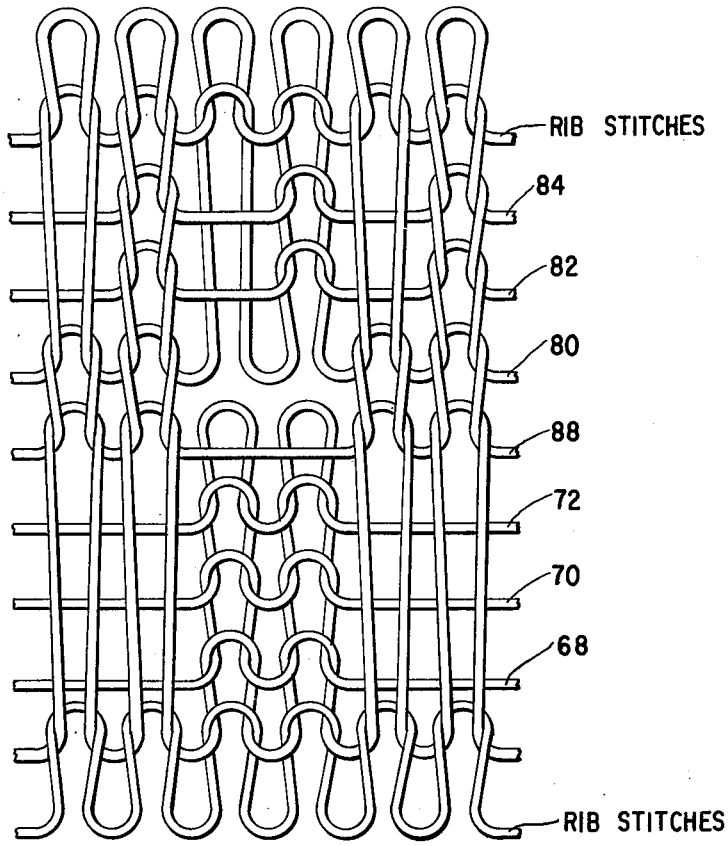
FIG. 25 is a schematic representation of fabric produceable on the machine of the invention.

A cam 426 which rotates with the cylinder of machine 46 is provided to sequentially actuate plungers 114A, 114B, 114C, 184, 114E, 264, 114H and 114I at times (see FIGS. 23 and 24). The cam 426 is similar to and is controlled in the same manner as the plunger operating cam of U.S. Pat. No. 2,543,121 of S. Mishcon et. al. for Knitting Machine issued Feb. 27, 1951. During each revolution of the cam, a pin 428 which is mounted in section block retaining ring 52 and is engageable with a camming surface 430 on a sliding block 432 to which the cam 426 is attached, causes cam 426 to be moved to a radially inward position if it is not already in such position. The cam may then move past the plungers in such radially inward position in which case there is no actuation of the plungers by the cam. The cam may however, after being first moved radially inward by pin 428 be moved to a radially outward plunger actuating position by the action of another pin 434 on cam surfaces 436 of sliding block 432. Such pin 434 is carried on an arm 438 movements of which are controlled by mechanism 440 responsive to rotation of the cylinder and a timing chain 442 having links that predetermine whether the pin 434 is held in a position where it cannot engage cam surface 436 or is positioned to engage such cam surface and cause the cam to be moved to its radially outward position. When in its radially outward position cam 426 sequentially actuates the plungers 114A, 114B, 114C, 184, 114E, 264, 114H and 114I, and thereby ratcheting device 116A, ratcheting device 116B, ratcheting device 116C, striping box 48, ratcheting device 116E, cutting mechanism 144, ratcheting device 116H and ratcheting device 116I respectively.

Each of the ratcheting devices 116 (A, B, C, E, H and I) includes the adjustable pins like pins 140 in FIG. 7. Such pins are correspondingly located circumferentially in each device relative to the camm (such as cam 142 on pivoted lever 118A) with which they are engageable, and they should be correspondingly disposed laterally in selected positions in devices 116 (A, B, C, H, and I). In ratcheting device 116E, the lateral disposition of the pins should be opposite to that in devie 116 (A, B, C, H, and I) so as to cause the automatically operable cams in dial section block 28 responsive to ratcheting device 116E to be moved to radially inward positions when the automatically operable dial and cylinder cams responsive to the other ratcheting devices 116 (A, B, C, H and I) are moved into positions for raising needles to knit positions, and to cause the automatically operable cams in dial section block 28 to be moved into radially outward positions when the other automatically operable cams are moved into positions permitting needles to welt. The disposition of jacks 192 and 194 in the drum 158 of striping box 48 and the manner of its operation is such as to cause thread carrying finger 148 and yarn carrying finger 150 to be in their operative and inoperative positions respectively when the cams responsive to ratcheting 116 (A, B, C, H and I) are in the position permitting needles to welt, and to cause the thread carrying and yarn carrying finger to be disposed in inoperative and operative positions respectively when such cams are in the positions for raising needles to knit positions.

With the cam responsive to the ratcheting devices 116A, 116B, 116C, 116H and 116I (that is pattern placers cams 116A, 116B, 116C, 116H and 116I in cylinder section blocks 10, 14, 18, 38 and 42 respectively, and raise cams 294H and 294I in dial section blocks 40 and 44 respectively) in positions permitting needles to welt, and therefore raise cams 294E and 296E in dial section block 28 responsive to ratcheting device 116E in their radially outward positions and the draw thread 88 being fed by the striping box; yarns 68, 70, 72, 74, 82 and 84 are out or engagement with the positive feed means and the machine 46 operates to produce separable strips as will not be described.

Courses of fabric may be knitted as with rib stitches in a conventional manner, from yarns (not shown) extending to needles at cylinder and dial section block pairs 446 and 448 respectively which extend around the machine from the section block pairs 10 and 12, 14 and 16, 18 and 20, 22 and 24, 26 and 28, 30 and 32, 34 and 36, 38 and 40, 42 and 44, and which may support cylinder and dial cams as shown for example in the aforementioned U.S. Pat. Nos. 3,513,666 and 3,893,309 respectively. Such yarns are positively fed over wheels (not shown but similar to wheel 411) of positive feed means 86 as in U.S. Pat. No. 3,090,215.

At section block pairs 10 and 12, 14 and 16, 18 and 20, cylinder needles welt and all dial needles knit yarn (i.e. yarns 68, 70 and 72 respectively) to form during a revolution of the cylinder and dial, three courses defining a edge portion in the fabric which is non-running due to the presence of the welt floats effective to prevent running of the dial stitches. At section block pair 22 and 24, all cylinder and dial needles knit a course with draw thread 88 adjacent to each non-running edge portion formed with yarns 68, 70 and 72. At section block pair 26 and 28 no yarn is fed to the needles and cylinder needles remain at welt level while all dial needles are raised to knit level causing the draw thread to be cast off the dial needles and latches of the dial needles to be closed. At section block pairs 30 and 32 no yarn is fed and the cylinder needles welt while all dial needles are raised to knit level. As the dial needles are raised their latches are opened by wire 352f. At section block pair 34 and 36 all cylinder and dial needles knit yarn 80 into a course adjacent each draw string course. At section block pair 38 and 40 alternate needles in the cylinder in cooperation with alternate needles in the dial knit rib stitches with yarn 82 and at section block pair 42 and 44 the same cylinder and dial needles knit rib stitches with yarn 84, the pattern wheels 143 and 145 being provided jacks for raising the alternate needles in the cylinder (jacks 450 and 452 in FIG. 3). Such rib stitches in conjunction with the course knitted with yarn 80 define a locked edge portion in the fabric, that is an edge portion which after separation of the fabric at the draw thread as described below exposes a smooth, clean, sharp edge and which can be stretched in the direction of the courses without stitches being pulled out of the fabric.

Fabric may be knitted on the machine of the invention with all needles in both the cylinder and dial (that is a needle in every slot of the cylinder and the dial) as shown, or it may for example be knitted with two needles in alternating with one out in both the cylinder and dial, or with three needles in alternating with one out in both the cylinder and dial. In each case needles 64 alternate with the needles 66 in the dial so that alternate ones of the needles actually in the dial are operated, and jacks would be provided in the pattern wheels 143 and 145 to raise every other one of the needles actually in the cylinder. With all needles in, 1X1 rib stitches are formed with yarns 82 and 84; with two in and one out, 2X1 rib stitches are formed; and with three needles in and two out, a 3X2 rib structure is produced.

After removal from the machine, fabric which has been knitted in the described manner during repeated revolutions of the cylinder and dial of the machine can (by pulling out the draw threads 88) be separated into strips having the non-running edge portion and locked edge portion with courses between such edge portions corresponding in number to the number of section block pairs 446 and 448.

The width of the strips knitted on the machine may be increased by an integral multiple of the number of cam section block pairs on the machine excepting cam section block pairs 26 and 28, 30 and 32 at which no yarn is fed to needles of the machine. Such increased widths are predetermined by the disposition of high and low links in timing chain 442 controlling the operation of cam 426 and the sequential disposition of pins in the ratcheting devices and jacks 192, 194 in the striping box. In this way the machine may for example be programmed to knit separable body portions of a sweater, dress or the like.

As has been noted when cam 426 is moved to its radially outward position, the various plungers, and thereby the ratcheting devices and striping box are actuated. With the pins disposed in the ratcheting devices to cause pattern placer cams 116A, 116B, 116C, 116H and 116I in cylinder section blocks 10, 14, 18, 38 and 42 respectively and raise cams 294H and 294I in dial section blocks 40 and 44 respectively to be then moved from positions wherein they permit needles to welt to positions for raising needles to knit level the raise cams 294E and 294E in dial section block 28 to be moved from their radially inward to their radially outward positions, the striping box 48 to feed yarn 74 instead of draw thread 88, and the yarns 68, 70, 72, 74, 82 and 84 to be therefore positively fed to the needles of the machine, all of the cylinder and dial needles are caused to knit yarn at each of the section block pairs 10 and 12, 14 and 16, 18 and 20, 22 and 24, 34 and 36, 38 and 40, 42 and 44 to produce courses which may correspond to those produced at the other section block pairs 446 and 448. Such knitting continues thereby increasing the width of a strip until the automatically operable cams are again repositioned and the striping box operated to feed the draw thread 88 in place of yarn 74. If it is desired to knit fabric on the machine without forming separable strips such repositioning of the cams and striping box operation is prevented by putting links in the timing chain 442 effective to prevent pin 434 from being positioned to cause cam 426 to be moved radially outward into its plunger actuating position after it is moved radially inward by pin 428.

While the invention has been described in its preferred forms, it is to be understood that the words which have been used are words of description rather than of limitation, and that changes within the purview of the appended claims may be made without departing from the true scope and spirit of the invention.

Having thus setforth the nature of the invention, what is claimed herein is:

1. In a cylinder and dial circular knitting machine for producing detachable strips of knitted fabric, the combination comprising a striping box; needle actuating camming at the striping box, and the striping box being selectively operable to feed yarn or draw thread to cylinder needles at the striping box associated camming; needle actuating cylinder and dial camming on each side of the striping box including adjustble cams movable between positions in which engaging needles are caused to perfom a knitting operation and positions in which needles are caused to weld; control means for positioning the adjustable cams, for causing the striping box to feed yarn when the adjustable cams are disposed to cause needles to perform a knitting operation, and for causing the striping box to feed draw thread when the adjustable cams are disposed to cause needles to welt; means for positively feeding yarns to needles at the adjustable cams and striping box when the positions of the adjustable cams is such as to cause needles to knit and the striping box is feeding yarn; and means for disengaging the yarns from the positive feed means when the adjustable cams are moved to cause needles to welt and the striping box to feed draw thread.

2. The combination of claim 1 wherein the control means includes cam means rotatable with the cylinder and dial of the machine and further includes mechanism engageable at times with the cams means for actuating the striping box and positioning the adjustable cams.

3. The combination of claim 2 wherein said mechanism operatively connects with the yarn disengaging means.

4. The combination of claim 2 wherein the control means includes means for moving the cam means rotatable with the cylinder and dial between a position wherein the cam means may engage said mechanism and a position in which engagement with said mechanism is prevented.

5. The combination of claim 1 including pattern wheels associated with a plurality of the adjustable cams.

* * * * *

UNITED STATES PATENT OFFICE

CERTIFICATE OF CORRECTION

Patent No. 4,033,150 Dated July 5, 1977

Inventor(s) Lester Mishcon and John Christopoulos

It is certified that error appears in the above-identified patent and that said Letters Patent are hereby corrected as shown below:

Column 4, line 67, "fing" should read -- finger --

Column 5, line 11, "extendings" should read -- extends --

Column 6, line 48, "2096C" should read -- 296C --

Column 7, line 9, "38" should read -- 28 --

Column 7, line 16, "ger" should read -- gear --

Column 7, line 34, "nd" should read -- and --

Column 7, line 54, "responsove" should read -- responsive --

Column 7, line 65, after "402", insert -- 404 --

Column 8, line 32, "neeldes" should read -- needles --

Column 9, line 14, "camm" should read -- cam --

Column 9, line 19, "devie" should read -- device --

Column 9, line 53, "not" should read -- now --

UNITED STATES PATENT OFFICE

CERTIFICATE OF CORRECTION

Patent No. 4,033,150 Dated July 5, 1977

Inventor(s) Lester Mishcon and John Christopoulos

It is certified that error appears in the above-identified patent and that said Letters Patent are hereby corrected as shown below:

Column 11, line 11, "294E" should read -- 296E --

Column 12, line 9, "weld" should read -- welt --

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*